US005964355A

United States Patent [19]

Raura

[11] Patent Number: 5,964,355

[45] **Date of Patent: *Oct. 12, 1999**

[54] PROCEDURE AND APPARATUS FOR SEPARATING HEAVY PARTICLES OF MATERIAL FROM LIGHTER ONES

[75] Inventor: Pentti Raura, Valko, Finland

[73] Assignee: Sunds Defibrator Loviisa Oy, Valko, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/715,452

[22] Filed: Sep. 18, 1996

[30] Foreign Application Priority Data

Sep. 18, 1995 [FI] Finland ..... 954387

[51] Int. Cl.[6] ..... B07B 4/00; B03B 7/00

[52] U.S. Cl. ..... 209/20; 209/137; 209/139.1; 209/468

[58] Field of Search ..... 209/20, 691, 693, 209/695, 134, 136, 137, 138, 139.1, 142, 468, 469; 406/78, 138, 137, 136

[56] References Cited

U.S. PATENT DOCUMENTS

| | | | |
|---|---|---|---|
| 1,192,159 | 7/1916 | Blauvelt et al. | 209/134 |
| 2,291,661 | 8/1942 | Stump . | |
| 2,853,192 | 9/1958 | Berry | 209/469 |
| 2,864,501 | 11/1958 | Bolander . | |
| 2,903,132 | 9/1959 | Berry | 209/468 |
| 3,065,853 | 11/1962 | Binnix | 209/468 |
| 3,105,040 | 9/1963 | Wood . | |
| 3,799,334 | 3/1974 | Collins | 209/470 |
| 4,279,740 | 7/1981 | Isogaya | 209/12 |
| 4,692,068 | 9/1987 | Hanrot | 409/89 |
| 4,747,942 | 5/1988 | Strauss | 209/455 |
| 4,755,284 | 7/1988 | Brooks | 209/20 |
| 4,840,727 | 6/1989 | Humphrey | 209/134 |
| 5,006,226 | 4/1991 | Burt | 209/19 |
| 5,303,826 | 4/1994 | Buzga | 209/46 |
| 5,524,746 | 6/1996 | Massen | 198/443 |

FOREIGN PATENT DOCUMENTS

| | | | |
|---|---|---|---|
| 2048182 | 2/1992 | Canada | 209/134 |
| 1165772 | 10/1958 | France . | |
| 1388033 | 12/1964 | France . | |
| 2425279 | 12/1979 | France . | |
| 532388 | 8/1931 | Germany | 209/468 |
| 140626 | 1/1961 | U.S.S.R. | 209/134 |
| 344802 | 3/1931 | United Kingdom . | |
| 447229 | 5/1936 | United Kingdom | 209/468 |
| WO8904722 | 6/1989 | WIPO . | |

*Primary Examiner*—William E. Terrell
*Assistant Examiner*—Wonki K. Park
*Attorney, Agent, or Firm*—Birch, Stewart, Kolasch & Birch, LLP.

[57] ABSTRACT

Procedure for separating heavy particles of material from lighter particles, e.g. for separating impurities from powdery or fragmental material, such as fibers or chips, in which procedure the material (2) to be treated is supplied onto a carrier surface (1) pervious to gas and gas impacts (P) are applied to the material through the carrier surface (1), causing the heavier particles to move closer to the carrier surface (1). The carrier surface (1) is mainly moved in one direction of movement to move the heavy particles (R) and the lighter particles (K) are passed, mainly by the agency of the inclination of the carrier surface (1) and/or the gas flow, in a direction substantially differing from the principal direction of movement of the carrier surface (1). The invention also relates to an apparatus implementing the procedure.

21 Claims, 3 Drawing Sheets

PROCEDURE AND APPARATUS FOR SEPARATING HEAVY PARTICLES OF MATERIAL FROM LIGHTER ONES

BACKGROUND OF THE INVENTION

1. Field of the Invention

The present invention relates to a procedure as defined in the preamble of claim 1 for separating heavy particles of material from lighter ones, e.g. in mineral separation technology or for separating impurities from powdery or fragmental material, such as chip or fiber material. The invention also relates to an apparatus as defined in claim 6.

2. Background Art

Examples of powdery or fragmental materials are different fibers, chippings and wood chips used in the manufacture of chipboard or fiberboard and the like. In the manufacture of such boards, increasing use is being made of waste material. This has led to a need to remove impurities from the materials used for board manufacture. Such impurities include various minerals, rocks, sand, etc. Solutions are known in which impurities are separated from materials by merely using an air current. These solutions have the drawbacks of high energy consumption and dust emissions. Moreover, in purification based on the use of a gas flow, fine impurities cannot be removed as desired, leading to an unsatisfactory purification result.

In mineral separation technology, a known method is dry Digging or pulse separation. In pulse separation, short gas impacts are applied from below to material flowing on a carrier surface pervious to gas. The lifting effect of the gas impact on a heavier particle is smaller than on a lighter particle because of the lower acceleration of the former. Therefore, the lighter particles, which have risen higher during the gas impact, come down more slowly during the intermission and are concentrated in the top art of the material layer. The heavier particles are concentrated in the bottom part of the layer. To separate the layers, they must be moved from the input end of the carrier surface towards its output end. The movement is achieved e.g. by using directional vibration, and the separation is performed e.g. at the output end by using a separating knife or, before it, a screw that moves the bottom layer to one side of the apparatus. The separation of the aforesaid layers has been determined according to the highest mineral quantity. In this case, the mineral content of the bottom layer is usually only 10–50%, which means that further enrichment is required.

SUMMARY OF THE INVENTION

The object of the present invention is to achieve a completely new separating method and an apparatus that obviates the drawbacks of prior-art solutions.

The invention is characterized by what is presented in the claims.

The solution of the invention has numerous significant advantages. With the procedure and apparatus of the invention, a very good separation efficiency is achieved. By providing a guiding element, such as a wall, above the carrier surface, a very good separation efficiency is achieved even when a horizontal carrier surface is used. By providing the wall with a regulating element, a very good variability of gas flow at the material input point is achieved. The carrier surface can also be adjusted into positions other than horizontal. A very advantageous construction is achieved by using a belt conveyor pervious to gas as a carrier surface. By implementing the carrier surface as a belt conveyor which is pervious to air and moves upwards in the direction of inclination, a very good separation efficiency is achieved. The separation efficiency can be further improved by using additional blasting and/or a pressure difference. By providing the carrier surface with protrusions, its transport efficiency can be increased. The separation efficiency can be further enhanced by dividing the space below the carrier surface into several sections e.g. by means of partitions, so that a different gas impact or gas pressure can be applied to each section if necessary.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described by referring to the attached drawings which are given by way of illustration only, and thus are not limitative of the present invention, and, in which.

DESCRIPTION OF THE PREFERRED EMBODIMENTS

Figure 1:
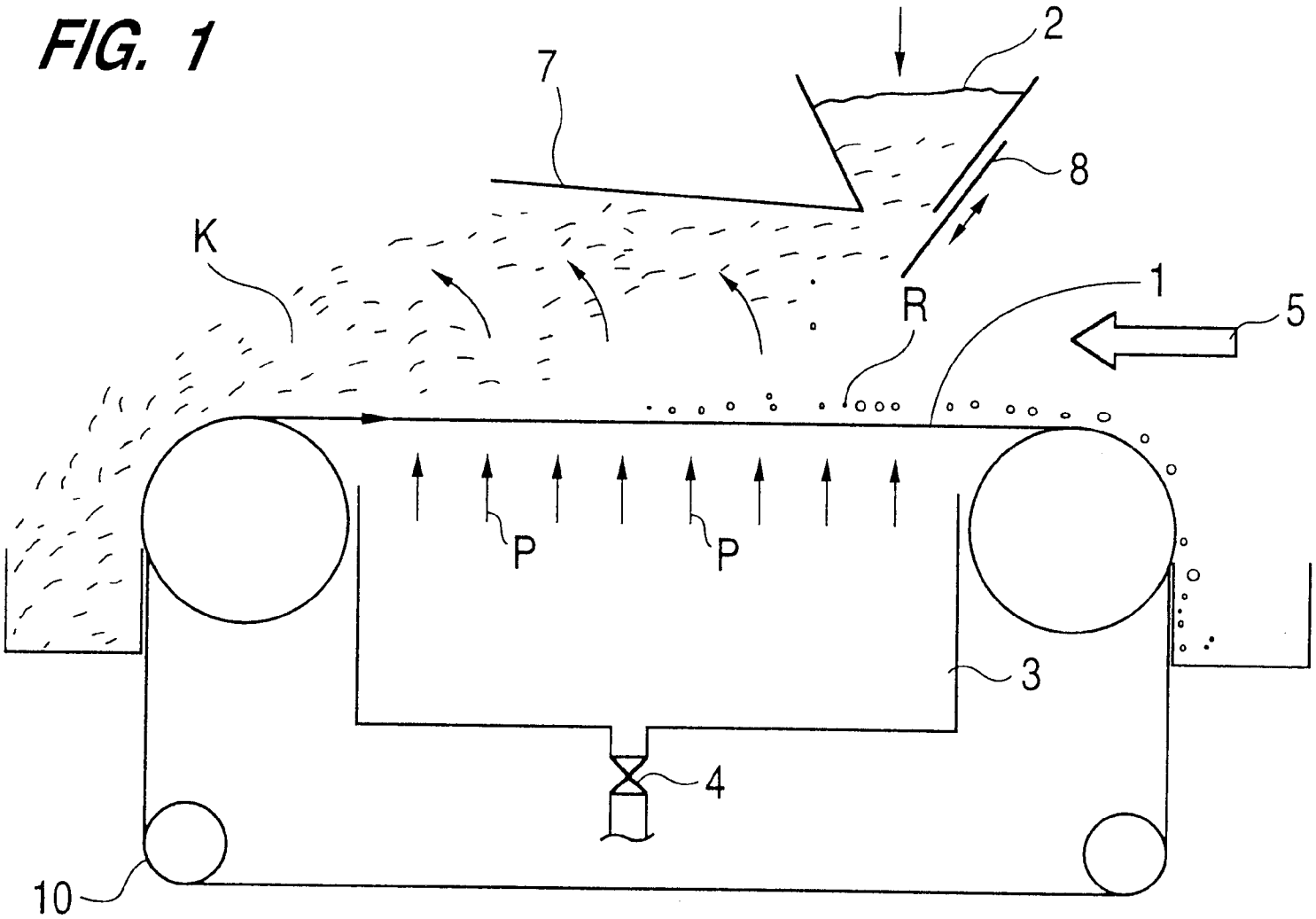
FIG. 1 presents an apparatus of the invention in simplified side view.

The apparatus of the invention comprises a carrier surface 1 pervious to gas, onto which the material to be treated is supplied. The motion of the carrier surface 1 is mainly a movement in one direction, and it may be continuous or intermittent. The carrier surface may also move through a certain distance and then return to its initial position. The carrier surface 1 is preferably an endless belt which is moved in the direction indicated by the arrows. Disposed below the carrier 1 are means 3, 4 for producing gas impacts P and applying them through the carrier surface 1 to the material flow. The means for producing gas impacts P comprise a chamber 3 disposed under the carrier surface 1, into which chamber gas is supplied and whose wall opposite to the carrier 1 is provided with at least one aperture, and at least one valve element 4 for regulating and/or closing the gas flow passing through the aperture/apertures, by means of which the gas impacts are thus produced.

According to the procedure of the invention, material 2 to be sorted is brought onto the carrier surface 1 pervious to gas and gas impacts P are applied to the material through the carrier surface 1, causing heavier particles to move into the area closest to the carrier surface. The carrier is mainly moved in one direction to move the heavy particles R, while the lighter particles K are passed on, mainly by the agency of the inclination of the carrier 1 and/or the gas flow, in a direction substantially differing from the principal direction of movement of the carrier 1.

The embodiment illustrated by FIG. 1 uses a guiding element 7, such as a wall 7, placed at an optional angle above the carrier surface to direct the gas flow of the gas impacts P in the space between the wall 7 and the carrier surface 1.

The wall enables the gas of the gas impacts to be used to convey the lightest particles K, such as chips and fibres. In this figure, the wall 7 directs the gas flow to the left as indicated by the arrows.

Placed in conjunction with the wall 7, preferably at the point of material input, is a regulating element 8 for controlling the gas flow. The regulating element 8, preferably a plate-like element, is specifically designed to control the velocity of gas flow at the point of material input.

The valve element 4 is so designed that, when in the closed position, it does not permit any significant amounts of gas to flow from the chamber 3 through the aperture opposite to the carrier. In the open position of the valve element, gas is allowed to flow from the chamber via the aperture and through the carrier.

The apparatus of the invention works as follows:

The material 2 to be treated, which contains particles of heavier and lighter specific gravity, is supplied onto the carrier surface 1. Short uplifting gas impacts P are applied through the carrier surface 1 to the material flow. The gas impact P has a smaller uplifting effect on a particle R of heavier specific gravity than it has on a particle K of lighter specific gravity, due to the lower acceleration of the former. The lighter particles K, which have risen higher during the gas impact P, are carried along with the gas flow guided by the wall 7 and fall down during the intermission at some distance in the direction of the guided gas flow. Thus, as a result of repeated gas impacts P, the lighter particles K are passed on faster in the direction of the gas flow than the heavier particles R. When the carrier is a belt 1 which is pervious to gas and moves against the gas flow at a velocity lower than the velocity of the light particles K moving in the direction of the gas flow but higher than the corresponding velocity of the heavy particles R, the light particles are carried by the gas flow (to the left in the figure), whereas the heavy particles R are carried by the belt conveyor 1 (to the right in the figure). In this way, particles of heavier specific gravity are separated from lighter particles. Light particles K are thus removed from the carrier 1 via its one end (left-hand end in the figure) while heavier particles R are removed via the opposite end (the right-hand end in the figure).

The gas impacts P are produced by supplying gas, preferably air, into the chamber 3 below the carrier 1 and using a valve element 4 to repeatedly interrupt the gas flow directed at the carrier 1 from below. Typically, gas impact pulses are produced e.g. at a rate of 1–10 pulses/s. The duration of a gas impact is typically 10–50% of the pulse duration.

Figure 2:
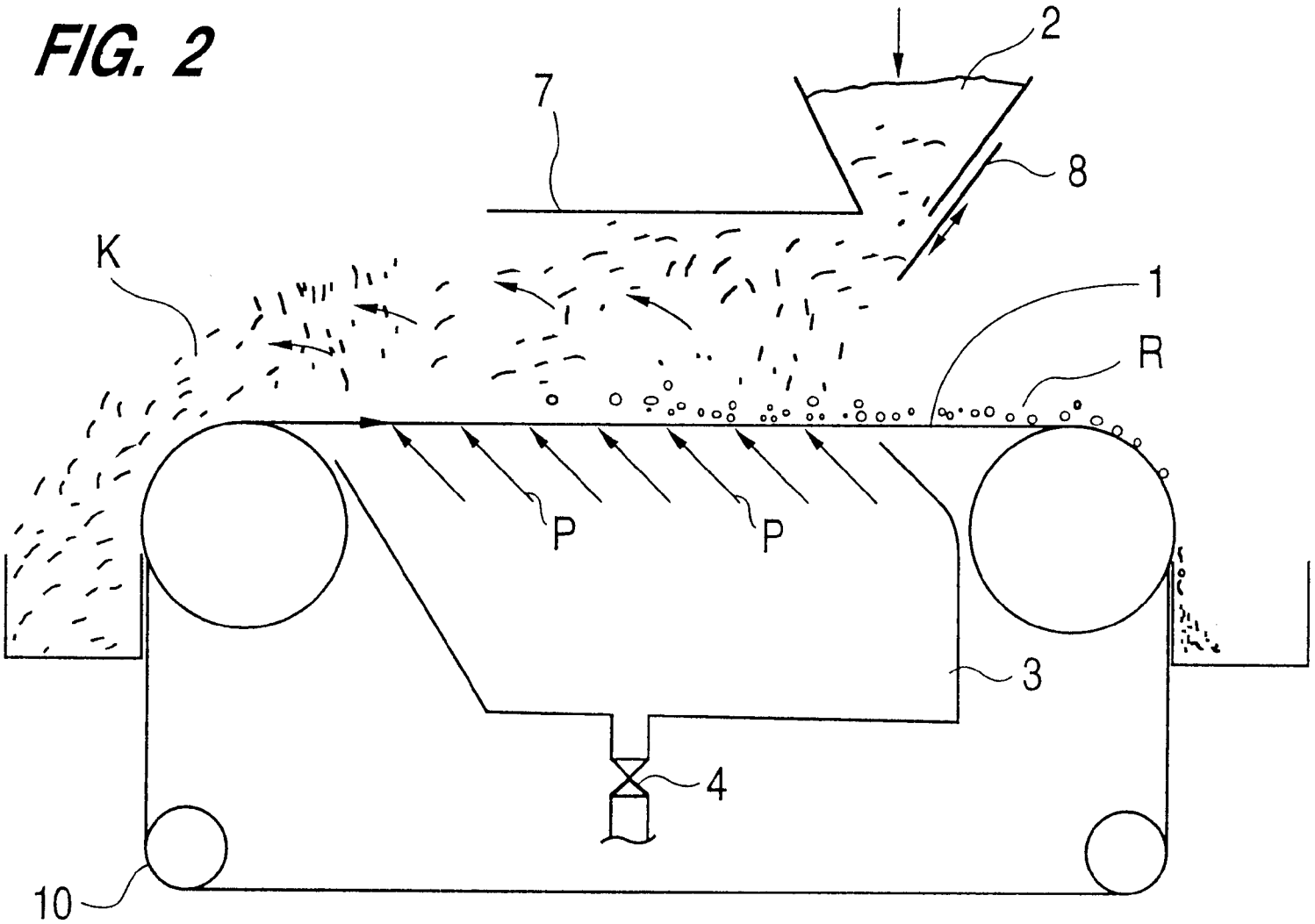
FIG. 2 presents another embodiment of the apparatus of the invention in simplified side view.

FIG. 2 presents another preferred embodiment of the invention, in which the gas impacts P are applied in a direction differing from the vertical, preferably in a direction obliquely against the direction of movement of the carrier surface 1. The lighter K and heavier R particles typically behave in a manner corresponding to the case illustrated by FIG. 1. Naturally it is possible in this embodiment as well to use a wall 7 as a means of directing the gas flow.

Figure 3:
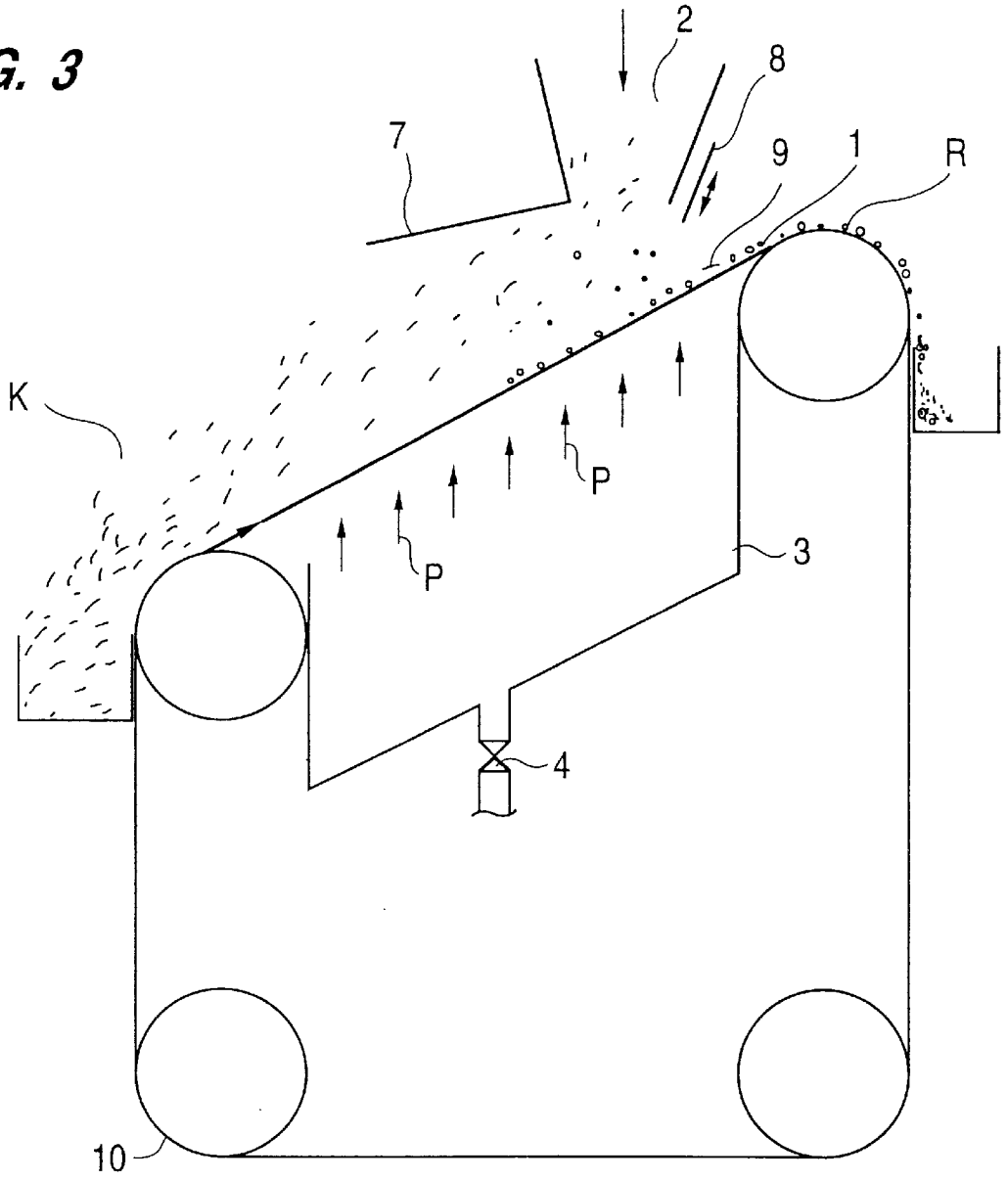
FIG. 3 presents a third embodiment of the invention in simplified side view.

FIG. 3 presents a third embodiment of the invention. The apparatus comprises an inclined carrier 1 pervious to gas, onto which the material to be sorted is supplied, preferably from the upper end. The carrier 1 is preferably an inclined endless belt driven in the direction indicated by the arrows, the belt in the inclined section being moved in an upward direction. Disposed below the carrier 1 are the means 3, 4 for producing gas impacts and applying them through the carrier 1 to the material flow.

The apparatus of the invention works as follows:

Material 2 containing particles of heavier and lighter specific gravity is supplied onto the carrier surface 1 from its upper end. Short uplifting gas impacts P are applied to the material flow through the carrier surface 1. The gas impact P has a smaller uplifting effect on a particle R of heavier specific gravity than it has on a particle K of lighter specific gravity, due to the lower acceleration of the former. On the inclined carrier 1, the lighter particles K, which have risen higher during the gas impact P, fall down at some distance in the direction of the inclination during the intermission. Thus, as a result of repeated gas impacts P, the lighter particles K are passed on faster in the direction of the inclination than the heavier particles R. As the carrier is a belt conveyor 1 which is pervious to gas and moves in the up direction of the inclination at a velocity lower than the velocity of the light particles K moving in the down direction of inclination but higher than the corresponding velocity of the heavy particles R, the light particles move downwards whereas the heavy particles R move upwards. In this way, particles R of heavier specific gravity are separated from lighter particles K. Light particles K are thus removed from the carrier 1 via its lower end while heavier particles R are removed via the upper end.

Furthermore, the carrier 1 can be divided into sections e.g. by means of partitions placed below it, permitting a different gas impact to be applied to each section if necessary. Also, the gas pressure below the carrier can vary from section to section. In this embodiment as well, it is possible to use a guiding wall 7 and/or directed gas impacts as in FIG. 2. With these solutions, the separating capacity and efficiency of the apparatus can be further improved.

By providing the belt of the belt conveyor 1 with protrusions 9 jutting out from the surface of the belt, the transport efficiency of the belt and therefore also the separating capacity of the apparatus can be enhanced. In addition, this prevents heavier material, such as sand grains, from slipping down along the sloping surface. The protrusions 9 may typically consist of ribs or the like, preferably extending across the whole width of the belt. In a typical application, the ribs are placed on the belt at distances of approx. 10–100 mm, e.g. 30 mm. The rib height is about 0.5–10 mm, preferably 1–3 mm. In the case illustrated by the figure, the belt 1 is moved by means of rollers 10, at least one of which is a driving roller.

The separating efficiency can be further improved by using additional blasting 5 for conveying the lighter particles. A pressure difference can also be used to enhance the separating efficiency.

It is obvious to a person skilled in the art that the invention is not restricted to the examples of its embodiments described above, but that it may instead be varied in the scope of the claims presented below. Thus, besides being used for the separation of impurities from chip or fiber material, the invention can be used in other separation applications as well. The carrier may be mounted in a horizontal position or in a position deviating from the horizontal in either direction.

I claim:

1. A method for separating heavy particles of material from lighter particles, comprising the steps of:

supplying material to be treated onto a gas pervious carrier surface;

moving the carrier surface generally in a first direction, said carrier surface having an upstream end and a downstream end;

applying intermittent gas impacts through the carrier surface while moving the carrier surface;

substantially moving the lighter particles in a second direction generally opposite the direction of movement of the carrier surface;

collecting the lighter particles at the upstream end of the carrier surface; and moving the heavy particles toward the carrier surface and in the first direction to collect the heavy particles at the downstream end of the carrier surface in order to separate the heavy particles from the lighter particles.

2. The method of claim 1, further including the step of providing the carrier surface in an inclined position in order to aid in moving the lighter particles in said second direction.

3. The method of claim 2, wherein the step of providing the carrier surface in an inclined position further includes the step of moving the carrier surface upwards in the direction of inclination, the heavy particles being moved upwards with the carrier surface to be collected at the downstream end of the carrier surface.

4. The method of claim 1, further including the step of directing the gas impacts in a direction differing from the vertical in order to aid in moving the lighter particles in said second direction.

5. The method of claim 1, further including the step of providing a guiding element for directing the gas impacts in order to aid in moving the lighter particles in said second direction.

6. The method of claim 1, wherein the step of applying intermittent gas impacts to the material moves the heavy particles in the second direction, and wherein the step of moving the carrier surface further includes the step of moving the carrier surface in said first direction at a velocity which is lower than the velocity of the lighter particles in said second direction, but higher than the velocity of the heavy particles in said second direction.

7. The method of claim 1, further including the step of providing additional blasting in a direction opposite to the direction of movement of the carrier surface in order to aid the movement of the lighter particles.

8. The method of claim 1, further including the step of providing a pressure difference in order to aid the movement of the lighter particles.

9. An apparatus for separating heavy particles of material from lighter particles, comprising:

a gas pervious carrier surface for receiving material to be treated thereon, the carrier surface being movable generally in a first direction, said carrier surface having an upstream end and a downstream end;

means for applying intermittent gas impacts through the carrier surface to the material to be treated; and means for substantially passing the lighter particles in a second direction generally opposite the direction of movement of the carrier surface to collect the lighter particles at the upstream end of the carrier surface, wherein the heavy particles are collected at the downstream end of the carrier surface to separate the heavy particles from the lighter particles.

10. The apparatus of claim 9, wherein the means for passing the lighter particles includes a wall disposed at an optional angle above the carrier surface for directing the intermittent gas impacts.

11. The apparatus of claim 10, wherein there is a space between the wall and the carrier surface for allowing the lighter particles to be propelled by the intermittent gas impacts.

12. The apparatus of claim 11, wherein the wall is oriented at an angle with respect to the carrier surface.

13. The apparatus of claim 11, wherein the wall is oriented generally in parallel to the carrier surface.

14. The apparatus of claim 10, wherein the apparatus further comprises a regulating element adjacent to a location of material input, the regulating element cooperating with the wall in order to control the gas flow.

15. The apparatus of claim 10, wherein the wall is stationary at least during operation of the apparatus.

16. The apparatus of claim 15, wherein there is a hopper above the carrier surface and the wall is connected to and extends from a wall of the hopper.

17. The apparatus of claim 9, wherein the carrier surface is an endless belt.

18. The apparatus of claim 9, wherein the carrier surface is oriented in an inclined position.

19. The apparatus of claim 9, wherein the means for passing the lighter particles includes the intermittent gas impacts being applied to the lighter particles in a direction differing from the vertical direction.

20. The apparatus of claim 9, wherein the means for producing gas impacts includes a chamber into which gas is supplied, the chamber comprising:

a first wall adjacent to the carrier surface, the wall including at least one aperture therein; and a second wall remote from the carrier surface, the wall including at least one valve element therein.

21. The apparatus of claim 9, wherein the carrier surface includes protrusions formed thereon for aiding the movement of the heavy particles.

* * * * *